US007073299B1

(12) United States Patent
diGirolamo et al.

(10) Patent No.: US 7,073,299 B1
(45) Date of Patent: Jul. 11, 2006

(54) CIRCLE WALL TRACK

(75) Inventors: Edward R. diGirolamo, Raleigh, NC (US); Michael L. Torres, Raleigh, NC (US)

(73) Assignee: The Steel Network, Inc., Raleigh, NC (US)

( * ) Notice: Subject to any disclaimer, the term of this patent is extended or adjusted under 35 U.S.C. 154(b) by 103 days.

(21) Appl. No.: 10/349,824

(22) Filed: Jan. 23, 2003

(51) Int. Cl.
*E04B 2/82* (2006.01)
*E04G 21/14* (2006.01)

(52) U.S. Cl. ..... 52/241; 52/242; 52/245; 52/246; 52/247; 52/274; 52/293.3; 52/745.11; 52/745.14; 403/83; 403/84; 403/103; 403/104; 403/110

(58) Field of Classification Search ..... 52/241, 52/245, 247, 108, 293.3, 745.05, 745.09, 52/86, 481.1, 745.11, 745.12, 745.13, 745.14, 52/246, 242, 274, 588.1, 730.5, 730.1, 732.2; 403/84, 86, 103, 104
See application file for complete search history.

(56) References Cited

U.S. PATENT DOCUMENTS 2,269,384 A * 1/1942 Spinosa ..... 52/242
2,419,321 A * 4/1947 Lopes ..... 198/853
3,053,358 A * 9/1962 Gross ..... 52/696
3,260,022 A * 7/1966 Guyer et al. ..... 52/86
3,759,035 A * 9/1973 Schmidberger ..... 59/78.1
3,772,875 A * 11/1973 Viano ..... 59/78.1
4,432,519 A * 2/1984 Wright ..... 248/49
4,566,141 A * 1/1986 Mahoney ..... 4/506
4,679,763 A * 7/1987 Brotherton ..... 29/446
5,083,380 A * 1/1992 Robertson ..... 33/562
5,137,251 A * 8/1992 Jennings ..... 249/189
5,394,665 A * 3/1995 Johnson ..... 52/241
5,697,725 A * 12/1997 Ballash et al. ..... 403/231
5,816,002 A * 10/1998 Bifano et al. ..... 52/255
6,000,181 A * 12/1999 Wheeler ..... 52/241
6,094,877 A * 8/2000 White ..... 52/247
6,115,984 A * 9/2000 Paradis ..... 52/717.03
6,237,301 B1 * 5/2001 Paradis ..... 52/717.03
6,467,179 B1 * 10/2002 Wolf ..... 33/474
6,545,214 B1 * 4/2003 Russell et al. ..... 174/48
6,594,913 B1 * 7/2003 Reilly ..... 33/534
6,609,684 B1 * 8/2003 Van Scoy et al. ..... 248/49
6,625,942 B1 * 9/2003 Wheeler ..... 52/241
6,637,173 B1 * 10/2003 Wheeler ..... 52/745.12
6,655,100 B1 * 12/2003 Andino ..... 52/247

* cited by examiner

*Primary Examiner*—Jeanette Chapman
(74) *Attorney, Agent, or Firm*—Coats & Bennett, P.L.L.C.

(57) ABSTRACT

A curved metal track for receiving a series of metal studs and forming a part of a curved metal wall. The track comprises a plurality of sections with each section being pivotally connected to an adjacent section. Structurally each section comprises a base plate having opposed first and second end portions. Formed in the first end portion is a slit or opening. The second end portion of each section is adapted to be inserted into the slit or opening of an adjacently disposed section. A pivot connector is utilized to pivotally connect the first end portion of one section with the second end portion of another section. There is also provided a pair of opposed stud tabs that extend normal to the base plate and which are adapted to be secured to the sides of a stud. By pivotally connecting the individual sections of the track, the track can be curved and accordingly can be configured to form a part of a curved metal wall.

34 Claims, 4 Drawing Sheets

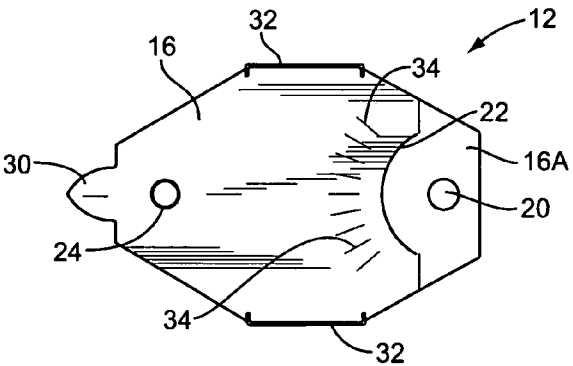
FIG. 3
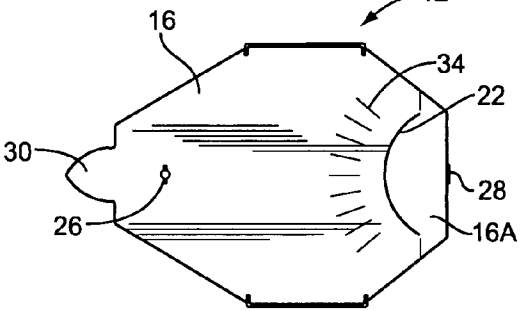
FIG. 4
FIG. 5
FIG. 6
FIG. 7
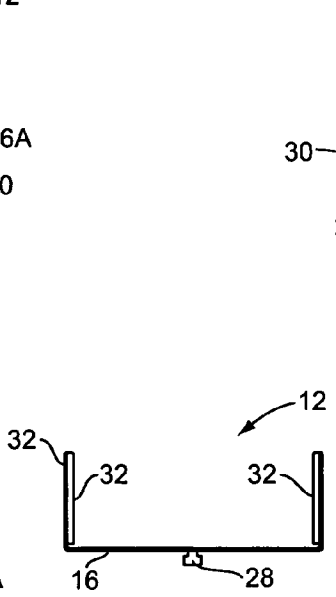
FIG. 8
FIG. 9
FIG. 10

CIRCLE WALL TRACK

FIELD OF THE INVENTION

The present invention relates to light steel framing and more particularly, to a track structure for receiving or retaining a plurality of metal studs that are disposed in a curved or arcuate configuration.

BACKGROUND OF THE INVENTION

Today metal walls are used in a wide variety of buildings including both the residential and commercial buildings. Basically, a metal wall section includes a series of spaced apart metal studs that extend between an upper and lower tracks that ordinarily are secured to an underlying floor and an overhead support structure. In some cases, the upper track may be free floating. Typically secured to the sides of the studs is a wall covering such as gypsum board. Most metal walls are straight. However, in recent years it is noted that many architects and interior designers have started to use curved walls in particular locations in buildings. In some cases these curved walls may be used purely for aesthetic or design appeal. In other cases, they may serve utilitarian functions.

In straight metal walls, the upper and lower tracks typically comprise an elongated U-shaped metal channel. Such channels are, of course, not suited for curved wall constructions. Yet, in order to fabricate a curve wall, it is necessary to provide a support or a retaining structure that runs along the upper and lower ends of the studs that comprise the wall.

In the past, there have been attempts at providing flexible track designs. For example, reference is made to U.S. Pat. No. 6,000,181 and the prior art discussed in this patent. U.S. Pat. No. 6,000,181 is expressly incorporated herein by reference. This patent discloses a multi-section track wherein the respective tracks are pivotally connected with respect to each other. However, this flexible or deformable track design includes an adjustable strap that is threaded through the upstanding stud tabs formed on each section. These straps make the flexible track complicated and expensive to manufacture. This complexity also can have an adverse affect on the ease of use of this flexible track.

Therefore, there has been and continues to be a need for a flexible or deformable track for a curved metal wall that is relatively simple in construction and which is easy to use.

SUMMARY OF THE INVENTION

The present invention relates to a flexible of curvable track for use in conjunction with a metal wall. The track includes a plurality of sections with each section including opposed first and second end portions. The first end portion includes a slit or opening and the second end portion is adapted to project into and through the slit or opening of an adjacent section when the sections are connected together. There is provided a pivot connector for connecting one end portion of one section with another end portion of a second section. This permits the sections to be coupled end-to-end.

In a particular embodiment of the present invention, the present invention entails a curved track for use in conjunction with a metal wall that comprises a series of sections adapted to be pivotally connected together with each section including a base plate. Further, each section includes a first opening and a connector wherein the connector of one section can be inserted into the opening of the other section so as to connect the two sections. In this embodiment the connector is formed by forming a second opening or protrusion in the base plate and by deforming a portion of the base plate and forming the deformed portion into a pivot connector that can be inserted into the first opening of another section. Thus, the pivot connecting structure, including the connector and the opening, is formed from the base plate of the section.

Finally, the present invention also entails a metal wall section having a curved track employed in the wall section. In this case, the wall section comprises a plurality of metal studs that are spaced apart and which are connected about the lower ends or the top ends, or both, by a curved track that includes a series of sections joined end-to-end and pivotally connected such that the track can conform to various curved or arcuate configurations that may be desirable for the wall section.

Other objects and advantages of the present invention will become apparent and obvious from a study of the following description and the accompanying drawings, which are merely illustrative of such invention.

BRIEF DESCRIPTION OF THE DRAWINGS

FIG. 3 is a top plan view of one section of the curved track.

FIG. 4 is an end elevational view of the section shown in FIG. 3.

FIG. 5 is a side elevational view of the section shown in FIG. 3.

FIG. 6 is a bottom plan view of the section shown in FIG. 3.

FIG. 7 is a top plan view of an alternate design for a section of the curved track.

FIG. 8 is an end elevational view of the section shown in FIG. 7.

FIG. 9 is a side elevational view of the section shown in FIG. 7.

FIG. 10 is bottom plan view of the section shown in FIG. 7.

DESCRIPTION OF EXEMPLARY EMBODIMENT

Figure 1:
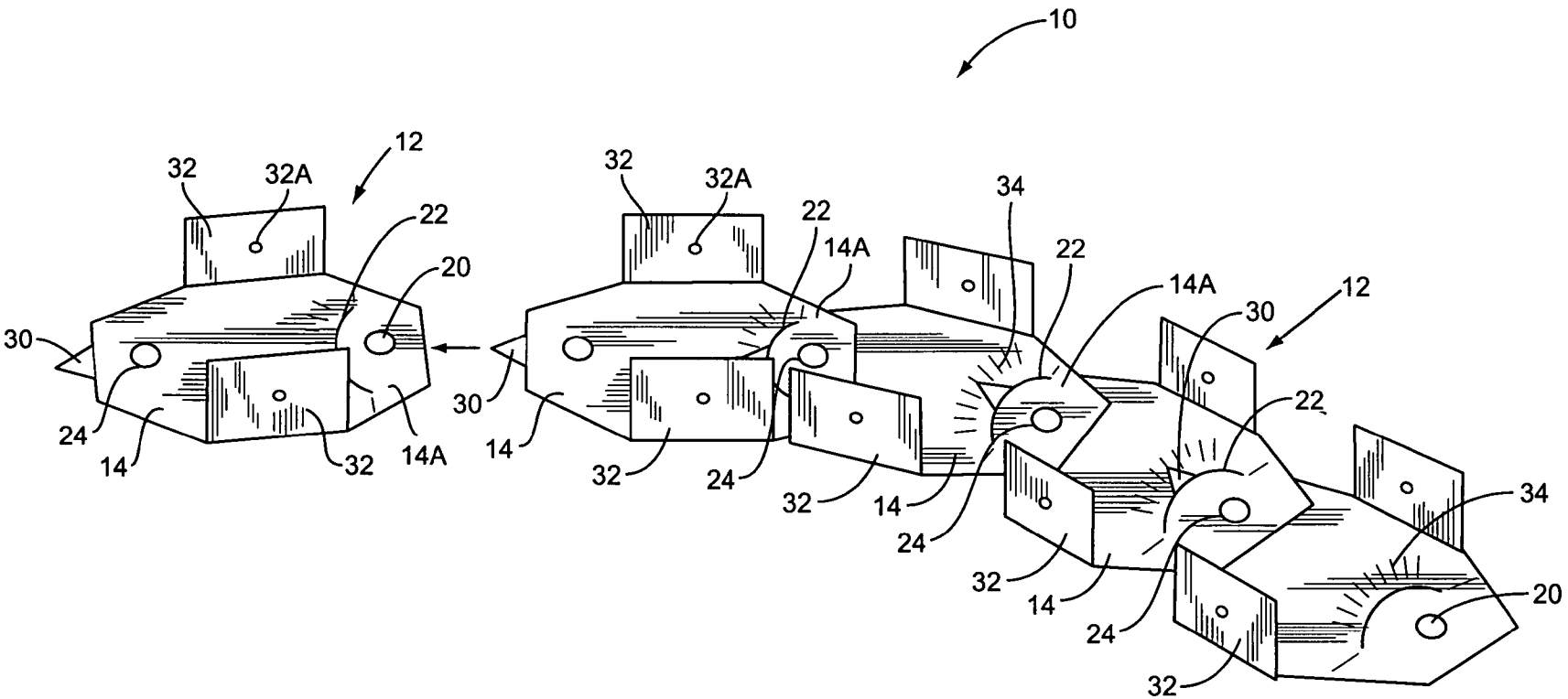
FIG. 1 is a perspective view showing a portion of the curved or flexible track of the present invention.

With further reference to the drawings, the curvable or flexible track of the present invention is shown therein and indicated generally by the numeral 10. Track 10 comprises a plurality of sections, indicated generally by the numeral 12, that are pivotally connected together end-to-end. As will be appreciated from subsequent portions of the disclosure, the individual sections 12 can be pivoted with respect to adjacent sections so as to form the track 10 into a wide variety of curved or arcuate configurations to accommodate the shape of a curved or arcuate shaped wall.

Viewing the individual sections 12, it is seen that each section 12 includes a base plate 14. The base plate can be constructed of various materials, but it is contemplated that in the case of metal wall construction that the base plate would be constructed of a light gauge metal. Base plate 14 can be shaped and fabricated by various operations. However, it is contemplated that the base plate could be efficiently formed through conventional cutting and stamping operations. The embodiment shown in FIGS. 3–6 includes a raised tail 14A. Other portions of the base plate can be raised and lowered in accordance with design criteria.

Each section 12 includes opposed end portions that are sometimes referred to as first and second end portions. The first end portion may be referred to as a trailing end portion. In any event, with reference to the embodiment shown in FIGS. 1–6, the first end portion or the trailing end portion includes an opening 20. Opening 20 functions to cooperate with a connector to connect the respective sections 12 end-to-end. Also formed about the first end portion is a slit or opening 22. Slit or opening 22 is formed along an edge of the raised tail 14A. In the case of the embodiment illustrated herein, the slit or opening 22 is generally arcuate shaped and is sized such that a part of the second end portion of a second section can be inserted through the slot or opening.

Turning to the second end portion, which is sometimes referred to as the leading end portion of the section, and with particular reference to the embodiment shown in FIGS. 1–6, there is provided a connector that is adapted to mate with the opening 20 formed in the first end portion. In the case of the embodiment shown in FIGS. 1–6, the connector includes a raised annular ring 24 formed in the second end portion or the leading end portion. This raised annular ring can be formed or fabricated in various ways. In one implementation, an opening can be formed in the first end portion and the material of the opening can be pressed and configured so as to form the upstanding raised annular ring 24 as particularly shown in FIGS. 4 and 5.

FIGS. 7–10 and 12 represent a second embodiment of the section 12. Basically this embodiment is similar to the first embodiment shown in FIGS. 1–6 with the exception of how the individual sections are connected or linked together. In the embodiment of FIGS. 7–10 this connection is achieved in a slightly different way from that discussed above and shown in FIGS. 1–6. Here, the first end portion or the leading end portion includes an elongated slot 26. Formed on the opposite end or the first end portion of the section is a turned connecting tab 28. Tab 28 is adapted to be inserted into the slot 26 of an adjacently disposed section 12. Once inserted into the slot 26, the tab 28 can be bent back against the base plate 16 so as to secure one section with another section. See FIG. 12.

Figure 2:
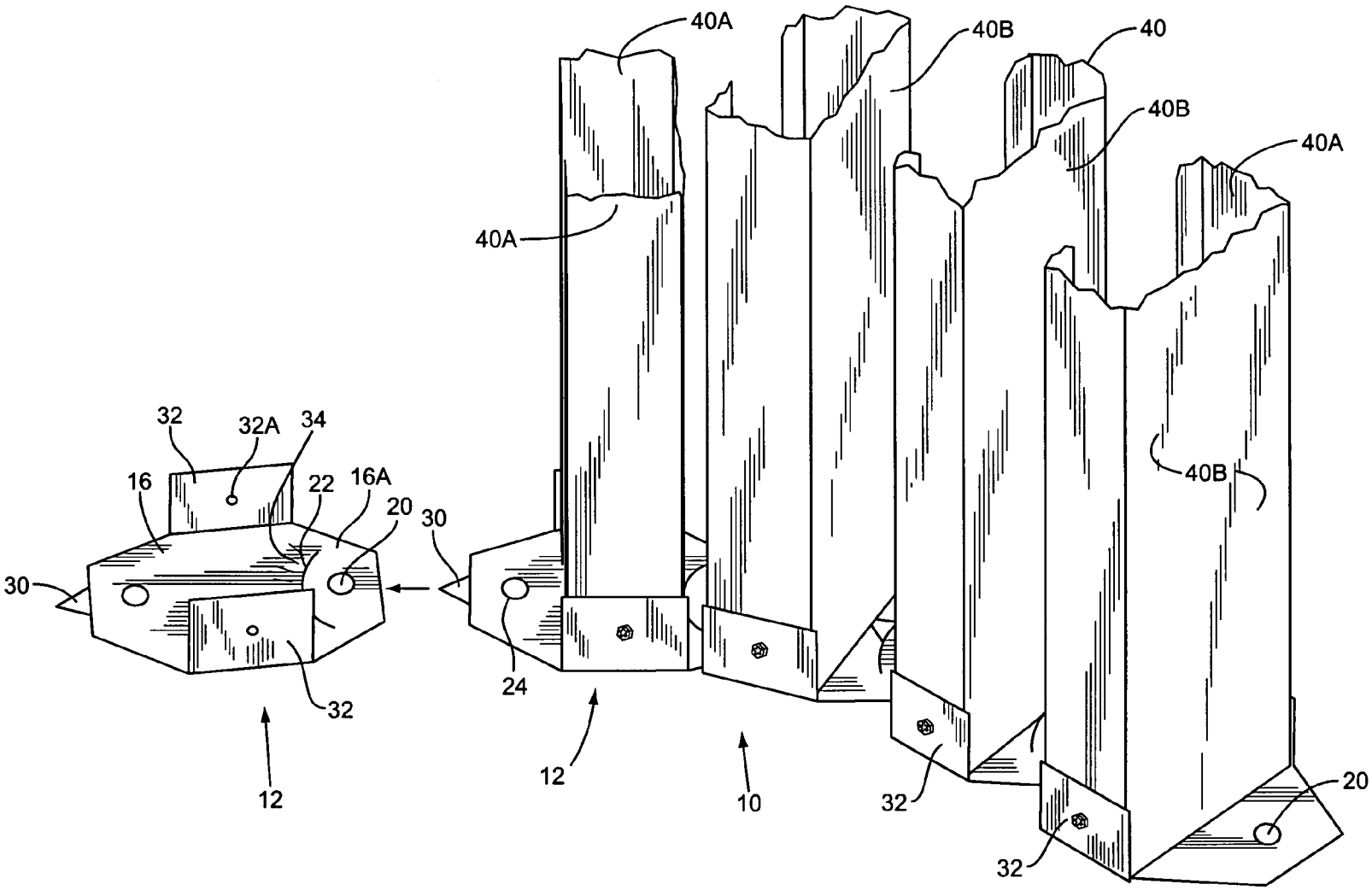
FIG. 2 is a fragmentary perspective view showing the curved track of FIG. 1 forming a part of a wall section.
Figure 11:
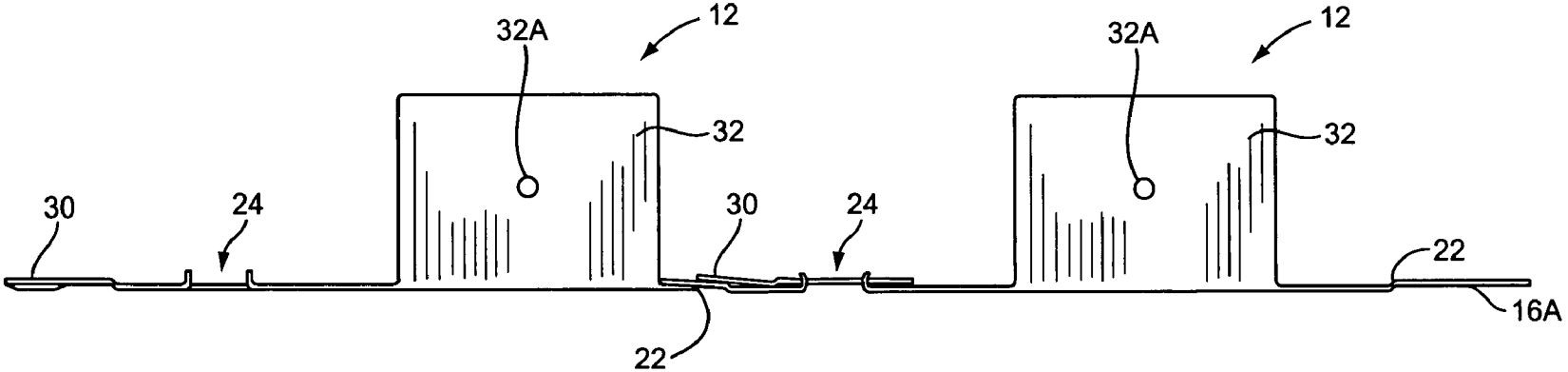
FIG. 11 is schematic elevational view illustrating sections of the first embodiment shown in FIGS. 3–6 connected together.
Figure 12:
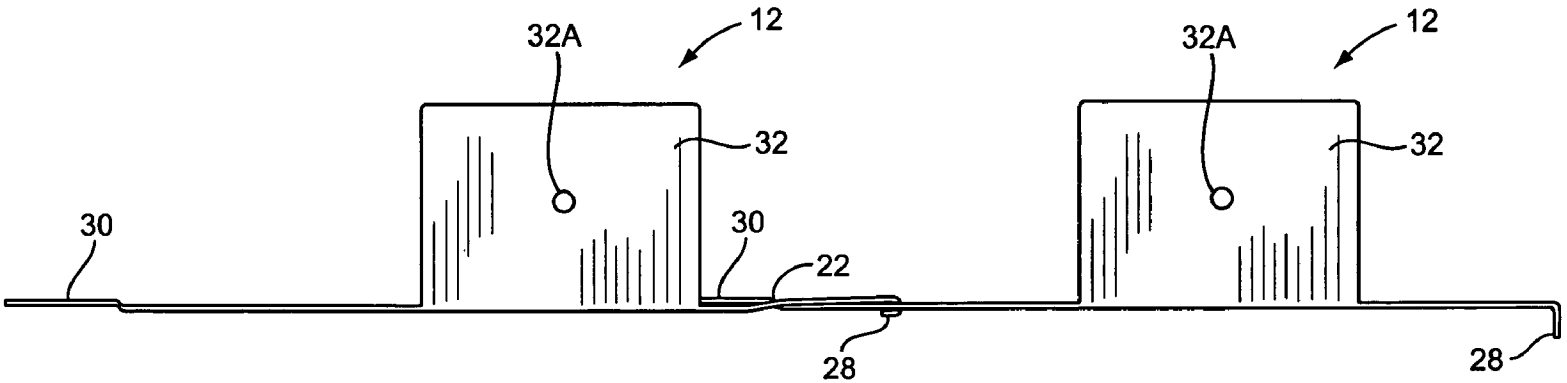
FIG. 12 is a schematic side elevational view illustrating sections of the second embodiment shown in FIGS. 7–10 connected together.

Returning to a description of section 12 of both embodiments, it is noted that formed about the second end portion or the leading end portion, there is a projection 30. The projection 30 in this case is integral with the base plate 14 and effectively forms a pointer. That is, when the sections 12 are coupled together, the projection 30 of each section 12 is inserted into and through the slit or opening 22 of an adjacent section, as illustrated in FIGS. 1 and 2. One side of the base plate 14 in the area adjacent the slit or opening 22 can be provided with indicia. This indicia, in combination with the projection 30, can indicate the relative angle that is formed by two connected sections. This indicia is particularly illustrated in FIGS. 3–10. The indicia in this case is in the form of a series of spaced apart angle markings 34. Thus, as seen in FIG. 1, the projection 30 extending through the slit or opening 22 points at a particular marking 34 or an area between a pair of markings. This is an indicator of the angle formed by the two connected sections.

This feature of the present invention can be utilized to assist construction crews in laying out a track 10 to conform to a certain curved or arcuate configuration. That is, if the curved or arcuate configuration desired is known, then the respective angles between consecutive sections 12 can be determined and through a set of instructions, a construction crew can layout the sections 12 to conform precisely to a designed curved configuration.

Each section 12 includes a pair of stud tabs 32. Stud tabs 32 include an opening 32A that is adapted to receive a screw or other fastener. More particularly, in constructing a wall section, a stud 40 can be inserted between the pair of stud tabs 32 associated with a particular section 12. Stud 40, in conventional fashion, would include a pair of flanges 40A and an interconnecting web 40B. The screw or fastener is inserted through the opening 34A of a respective stud tab 32 and into the flange 40A of a respective stud 40. Thus, the tabs 32 can be anchored or secured to the respective studs 40 of a metal wall section such as shown in FIG. 2.

It follows that in forming a curved or arcuate shaped metal wall, that the track 10 can be utilized to extend below or above a group of studs 40 that make up the curved or arcuate shaped wall. In most cases, the bottom track would be secured to an underlying floor structure such as a concrete slab. The upper track could be free floating or secured directly to an overhead support structure. It also follows that each section would not have to necessarily accommodate a stud 40. These studs can be selectively spaced in the track and in such cases, some of the sections 12 would simply form a segment of the track and would not connect to a stud.

From the foregoing specification and discussion, it is appreciated that the present invention entails a flexible track 10 that can be employed in a curved metal wall wherein the flexible track is of a relatively simple design and which is easy and economical to manufacture.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A curvable track for receiving metal studs, comprising:

a. a plurality of sections, wherein each section includes a top side and a bottom side;

b. each section including opposed first and second end portions;

c. the first end portion including a slit;

d. the second end portion of the respective sections projecting into and through the slits to extend under the bottom side and above the top side of other sections;

e. a pivot connector connecting a first end portion of one section with a second end portion of a second section such that a plurality of sections that comprise the track are pivotally connected together; and f. wherein the second end portions of the sections move back and forth through the slits of adjacent first end portions of other sections as the connected sections pivot with respect to each other.

2. The track of claim 1 wherein each section includes a pair of spaced apart upstanding stud tabs for connecting to a stud.

3. The track of claim 1 wherein the second end portion of each section includes a projection that projects through the slit formed in the second end portion of an adjacent section.

4. The track of claim 3 wherein the projection comprises a pointer.

5. The track of claim 4 wherein each section includes an indicia and wherein the relationship of the pointer with respect to the indicia indicates the relative angle assumed by two connected sections.

6. The track of claim 1 wherein the slit assumes a generally curved configuration and is formed by cutting a cut into the first end portion of the sections, and wherein the width of the cut is relatively thin compared to the length of the cut.

7. The track of claim 1 wherein one end portion of the section includes an opening and the other end portion of the section includes a connector, and wherein the pivot connector is formed by inserting the connector of one section into the opening of another section.

8. The track of claim 7 wherein the connector is formed by deforming a portion of the section such that the deformed portion of the section extends upwardly.

9. The track of claim 7 wherein the connector is formed by a connecting tab projecting from one end portion of the section and adapted to be inserted into a tab receiving opening formed about the other end portion of another section.

10. The track of claim 2 wherein the stud tabs of one section of the track are disconnected from the stud tabs of other sections of the track.

11. A curve track for receiving metal studs comprising:

a. a series of sections adapted to be pivotally connected together with each section including a base plate, each base plate have a top side and a bottom side;

b. each section including a first opening and a connector wherein the connector of one section can be inserted into the opening of another section so as to connect the two sections;

c. wherein the connector is formed by forming a second opening in the base plate by deforming a portion of the base plate and forming the deformed portion into the connector such that the formed connector can be inserted into the first opening of another section thereby permitting a plurality of sections to be pivotally interconnected; and d. each section including a slit in the form of a long and narrow opening, and wherein when the sections are pivotally connected together a portion of each section projects into and through the slit to extend under the bottom side and above the top side of an adjacent section.

12. The track of claim 11 the base plate includes first and second opposed end portions and wherein the first opening is formed in one end portion and wherein the formed connector is formed in the other end portion.

13. The track of claim 12 wherein each section includes a pair of opposed stud tabs for securement to a stud.

14. The track of claim 13 wherein the respective stud tabs of each section of the track are not connected directly or indirectly with the stud tabs of any other section of the track.

15. The track of claim 11 wherein the slit is generally arcuate shaped and is formed by cutting a cut into the each section, and wherein the width of the cut is relatively thin compared to the length of the cut.

16. The track of claim 11 wherein each section includes a projection that projects through a slit of another section when the sections are pivotally interconnected.

17. The track of claim 16 wherein each section is provided with indicia that is utilized in conjunction with the projection to indicate generally the relative angle assumed by two pivotally connected sections.

18. A curved metal wall including:

a. a plurality of spaced apart metal studs;

b. at least one curved metal track secured to the bottom or the top of the studs;

c. the track including a plurality of sections pivotally connected together such that respective sections may pivot with respect to each other, wherein each section includes a top side and a bottom side;

d. each section including opposed first and second end portions with the first end portion including a slit in the form of a long and narrow opening, and the second end portion adapted to project into and through the slit of an adjacently disposed section to extend under the bottom side and above the top side of the adjacently disposed section;

e. a pivot connector for connecting the first end portion of one section with the second end portion of another section such that the plurality of sections that comprise the track are pivotally connected together; and f. wherein the second end portion moves within the slit of an adjacent first end portion as two connected sections pivot with respect to each other.

19. The curved wall of claim 18 wherein each section includes a projection that projects through the slit formed in an adjacent section.

20. The curved metal wall of claim 18 including indicia formed on each section for indicating the angle formed by two connected sections.

21. The curved metal wall of claim 20 wherein each section includes a pointer that projects through the slit and which, in combination with the indicia, indicates the angle assumed by two connected sections.

22. A metal wall structure having a series of metal studs with the metal studs being connected to the curvable track of claim 2.

23. The metal wall structure of claim 22 wherein each metal stud includes a pair of flanges and is disposed over a respective section of the track, and wherein the flanges of the studs are disposed adjacent the stud tabs.

24. The curvable track of claim 1 wherein the slit formed in each section comprises a long, narrow opening formed across respective sections.

25. The curvable track of claim 24 wherein the slit extends generally transversely across respective sections.

26. The curvable track of claim 25 wherein the slit assumes a generally curved configuration.

27. The curve track of claim 11 wherein the slit formed in each section includes a long, narrow opening.

28. The curve track of claim 27 wherein the slit extends transversely across a substantial portion of each section.

29. The curve track of claim 27 wherein the slit assumes a generally curved configuration.

30. The curved metal wall of claim 29 wherein the slit extends transversely across the section.

31. The curved metal wall of claim 30 wherein the slit assumes a curved configuration.

32. The curved track of claim 11 wherein each section includes a top surface and a bottom surface and wherein when the sections are pivotally connected together, a portion of each section enters the slit from one surface and exits the slit from the other surface such that once the portion has been inserted into and through the slit, part of the portion lies adjacent the top surface and a part of the portion lies adjacent the bottom surface of the section.

33. The curved track of claim 1 wherein each section includes a top surface and a bottom surface and wherein when the sections are pivotally connected together, a portion of each section enters the slit from one surface and exits the slit from the other surface such that once the portion has been inserted into and through the slit, part of the portion lies adjacent the top surface and a part of the portion lies adjacent the bottom surface of the section.

34. The curved track of claim 18 wherein each section includes a top surface and a bottom surface and wherein when the sections are pivotally connected together, a portion of each section enters the slit from one surface and exits the slit from the other surface such that once the portion has been inserted into and through the slit, part of the portion lies adjacent the top surface and a part of the portion lies adjacent the bottom surface of the section.

* * * * *